United States Patent [19]

Bushner

[11] Patent Number: 4,895,371

[45] Date of Patent: Jan. 23, 1990

[54] GOLF PUTTER

[76] Inventor: Gerald F. Bushner, P.O. Box 246, Yuma, Colo. 80759

[21] Appl. No.: 225,776

[22] Filed: Jul. 29, 1988

[51] Int. Cl.[4] ..... A63B 53/00

[52] U.S. Cl. ..... 273/164; 273/171

[58] Field of Search ..... 273/167 F, 167 H, 171, 273/167 G, 169, 164

[56] References Cited

U.S. PATENT DOCUMENTS

| | | | |
|---|---|---|---|
| 194,823 | 3/1923 | Stirling | 273/171 |
| 645,942 | 3/1900 | Cran | 273/171 |
| 1,453,503 | 8/1921 | Holmes | 273/171 |
| 2,056,335 | 10/1936 | Wettlaufer | 273/171 |
| 3,652,094 | 3/1972 | Glover | 273/171 |
| 3,888,484 | 6/1975 | Zitko | 273/167 G |
| 3,955,819 | 5/1976 | Yokich | 273/167 F |
| 4,141,556 | 2/1979 | Paulin | 273/167 F |

*Primary Examiner*—Edward M. Coven
*Assistant Examiner*—Dean Small
*Attorney, Agent, or Firm*—Dallett Hoopes

[57] ABSTRACT

Putter head has bore behind and parallel to the face. Pin is disposed in bore having weight adjustable therealong. Modification includes tail centrally backward from main portion, the tail having a bore also enclosing a pin having a weight mounted adjustably on it. Changing or adjusting the weights can compensate for conditions of green and individual stroke faults.

1 Claim, 2 Drawing Sheets

GOLF PUTTER

BACKGROUND OF THE INVENTION

1. Field of the Invention

This invention relates to golf putters. More specifically, this invention relates to a golf putter which enables the golfer to make adjustments to the putter to have it compensate for the conditions (i.e., fast greens, slow greens) and for the golfer's individual swing (i.e., tendency to open or close the face, etc.). The putter head also has on its top surface indicia to help the golfer contact the ball properly.

2. Description of the Related Art Including Information Disclosed Under §§1.97–1.99

The prior art is replete with putter designs in which the shape of the putter is dictated by certain needs. Examples are disclosed in U.S. Pat. No. 3,758,115, which issued Sept. 11, 1973 to Hoglund; 3,880,430, which issued Apr. 29, 1975 to McCabe; 3,955,819, which issued May 11, 1976 to Yokich; and 4,141,556, which issued Feb. 27, 1979 to Paulin. The patents relate to putters which have a general T-shape including a top surface with indicia directed perpendicular to the face of the putter so that the line of sight assists the golfer in making proper contact with the ball.

In addition to the above, there is U.S. Pat. No. 3,240,497, which issued Mar. 15, 1966 to W. C. Taylor. This patent discloses a putter in which the head has a bore parallel to the face and a weight is mounted on a pin therein, the weight being replaceable with a heavier or lighter weight as desired.

SUMMARY OF THE INVENTION

Under the present invention a putter is provided having a bore parallel to the face, the bore receiving a pin with a weight slideably telescoped thereon and adjustably fixable therealong so that the position of the weight within the head can be fixed at the point at which it will do the most good for the purpose intended.

In a modified form of the invention a perpendicular tail extends rearward from a central location on the head, the tail having a bore perpendicular to the club face, this bore also including a pin having a weight telescoped thereon and fixable at a given location in the perpendicular bore.

By suitably adjusting the position of the weight or weights described above, the golfer can optimize the performance of the putter to compensate for conditions, such as the speed of the green and his own idiosyncrasies such as a tendency to open or close the face. In addition, with the modified form of invention the weight of the club head at the opposite ends of the face and the rear end of the tail serve to correct the effect of an inadvertently canted disposition of the face as it contacts the ball, snapping the head around to square position all as described more fully below.

BRIEF DESCRIPTION OF THE DRAWINGS

Other objects and features of the invention will be clear from the following specification and the drawings, all of which disclose nonlimiting embodiments of the invention. In the drawings.

DESCRIPTION OF THE PREFERRED EMBODIMENT

Figure 2:
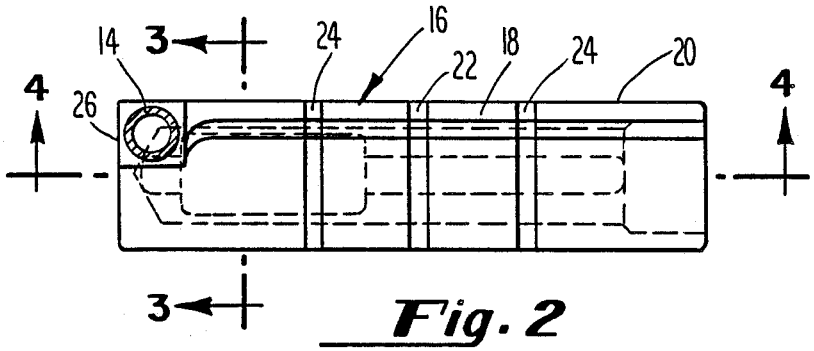
FIG. 2 is an enlarged top view of a putter head sectioned through the shaft showing in phantom the internal structure.
Figure 3:
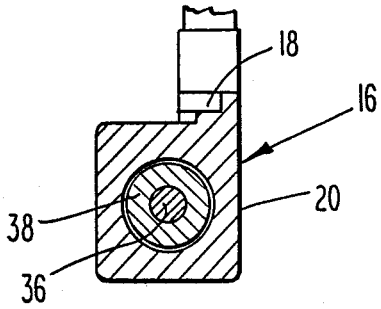
FIG. 3 is a sectional view taken on the line 3—3 of FIG. 2.
Figure 1:
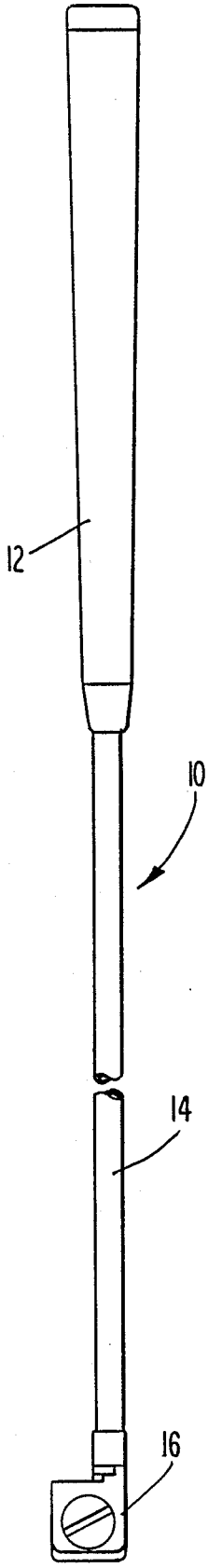
FIG. 1 is a side view of a putter embodying the invention.
Figure 7:
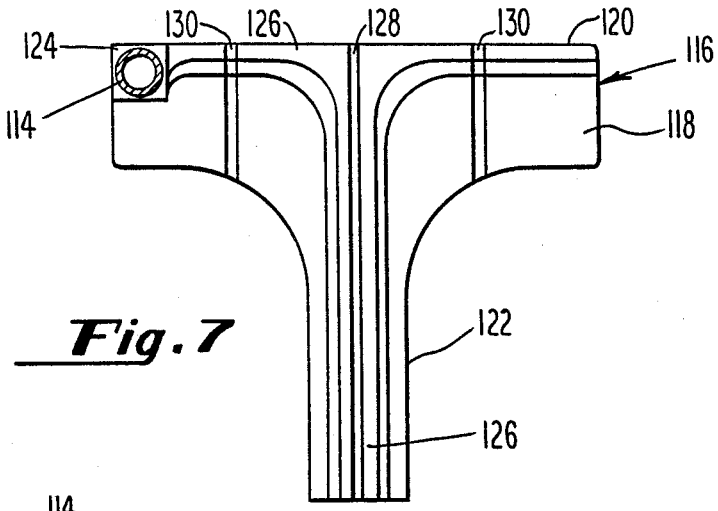
FIG. 7 is a top view of a modified form of the putter head embodying the invention.

A putter embodying the invention is shown in FIG. 1 and generally designated 10. It comprises a handle portion 12, a connected shaft 14 and a putting head 16 mounted on to the lower end of the shaft.The head 16 (FIG. 2) has a stepped upward ridge 18 along its front edge, upwardly enlarging the face 20.

Formed in the top surface of the head 16 are parallel grooves perpendicular to the face 20, comprising a central groove 22 and two parallel grooves 24 on either side thereof spaced from the central groove 22 a distance approximately equaling the radius of a golf ball. These grooves help the golfer line up the club and ball.

The shaft 14 is secured in a boss 26 in an end of the head depending on whether the golfer putts right- or left-handed.

The head 16 is formed with a blind bore 28 parallel to and spaced back from the face 20. The open end of the bore 28 is threaded at 30 to receive a threaded plug 32 which may have a drive slot 34 so that the plug can be removed with a coin or the like.

Figure 5:
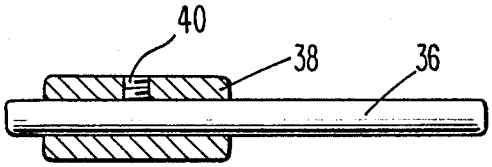
FIG. 5 is a view of the pin/weight assembly, the weight being shown in section.

Within the bore 28 is disposed a pin 36 on which is telescoped a tubular weight 38. The weight is formed with a radial threaded opening which receives a set screw 40 (FIG. 5) to fix the position of weight 38 on the pin.

Figure 4:
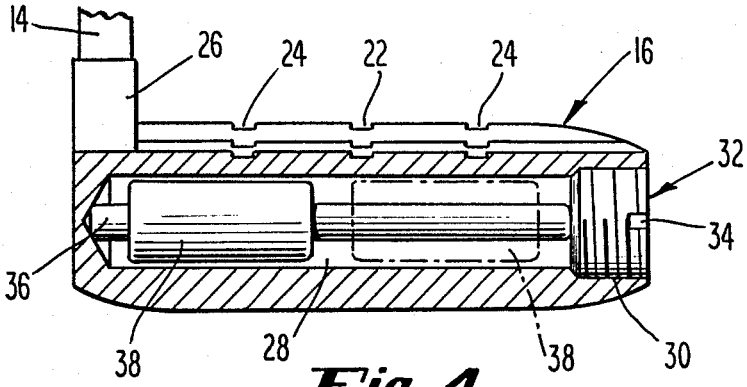
FIG. 4 is a sectional view taken on the line 4—4 of FIG. 2 and showing in phantom an alternate position of the weight.

The parts are proportioned so that when the plug 32 is screwed in all the way it bears against the adjacent end of the pin 36 to hold the pin firmly in position against the far end of the bore. As shown (FIG. 4), the weight 38 may be fixed at a variety of positions along the pin 36, but is most likely to be used in a position where it helps correct the tendency of the golfer to open or close his putting face. For instance, if the golfer has a tendency to close the face, the weight will be in the position shown in phantom in FIG. 4, tending to slow the movement of the outer end of the putter so that as it comes through the ball the face will not be closed. On the other hand, if the golfer tends to open the face, the position of the weight, as shown in solid lines to the left, would be more effective, slowing up the forward movement of the putter at the near end of the head to the shaft.

It should be understood that in proper putting the travel of the head approaching the ball is about one-third the total travel and the follow-through is about two-thirds. Thus as the putter approaches the ball it is still building up speed to a maximum speed which the putter reaches sometime after the ball has been struck. Hence, the effect of the weight 38 is to delay the speed build-up portion of the head where the weight is located.

The adjustment of the weight 38 along the pin will also result in a shift of the "sweet spot" so that the golfer who tends to hit the ball at some point on the club head other than the usual "sweet spot" can, with this club, adjust the "sweet spot" to the point where he hits it.

It should be clear that shifting the weight on the pin is accomplished by merely removing the screw plug 32, taking the pin/weight assembly out of the bore 28 and loosening set screw 40 and sliding the weight therealong to the desired new point, and then tightening the set screw and reinstalling the assembly in the bore and reapplying the screw plug.

Similarly the weight 38 may be replaced by a heavier or lighter weight depending on the speed of the green. For instance, if the greens are fast, a certain golfer, one who uses a smooth regulated stroke, will want a lightweight club. If they are slow, a heavier weight will be best for him. This way the golfer can use his same stroke and impart more or less impact to the ball.

On the other hand, a putter with an abrupt, snapping stroke will want just the opposite: for a slow green he will want a light head and for a fast green he'll want a heavy head. The beauty of the putter of this invention is that it makes available to each golfer a putter head having the best characeristics for that golfer's individual stroke and manner.

MODIFICATION

A more elaborate form of the invention is disclosed in FIGS. 6 through 11. In this modification the putter 100 (FIG. 6) comprises the handle portion 112, the shaft portion 114 therebelow and the head 116. As shown, the shaft may be offset as at 114*a*.

The top view (FIG. 7) sectioned across the shaft 114 shows that the modified head 116 comprises a T-shape body having a main portion 118 with its face 120 and a tail portion 122 which extends rearward perpendicular to the main portion 118 and centrally therefrom. The shaft 114 is mounted in a boss 124 at one end of the main portion 118.

Figure 8:
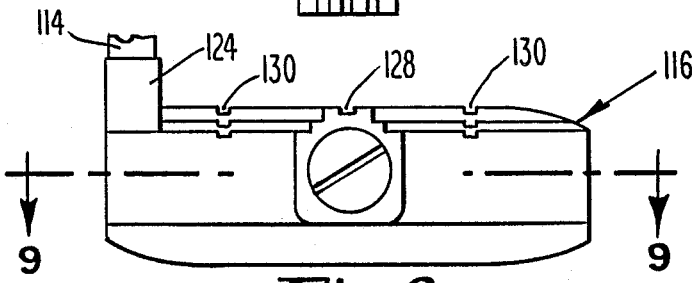
FIG. 8 is a rear view of the modified form.
Figure 9:
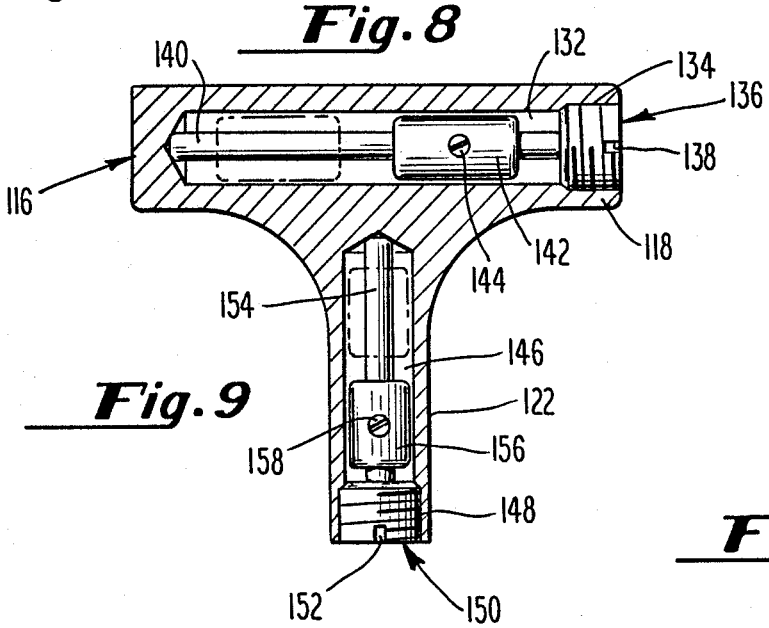
FIG. 9 is a sectional view taken on the line 9—9 of FIG. 8 and showing in phantom lines alternate positions of the weights.

The modified form is formed with the stepped ridges 126. As shown in FIG. 8, the stepped ridges extend rearwardly centrally of the tail 122. The top of the head includes a central sighting groove 28 which extends down the top of the stepped ridge 126, and the side grooves 130 which are parallel to and spaced from the central groove 128 by the distance of the radius of the golf ball.

The main portion 118 of the head is formed similarly internally to the head of the earlier described embodiment. It includes a blind bore 132, the open end of which is threaded as at 134, and receives a threaded plug 136 having a cross slot 138. Within the bore 132 is disposed the pin 140, which has telescoped over it the tubular weigth 142 having a set screw 144 which fixes the position of the weight on the pin. The weight may take different positions, as shown.

When the threaded plug 136 is tightened, it holds the pin 140 firmly with the far end in place against the end of the bore so that it does not rattle and the position of the weight 142 does not shift. The tail portion 122 of the body is similarly formed with a blind bore 146, the open end of which is threaded as at 148 and fitted with a threaded plug 150 having a cross slot 152. Disposed inside the bore 146 is the pin 154 on which is supported a tubular weight 156. As before, the weight is fitted with a set screw 158 for fixing its position on the pin 154. When the plug 150 is tightened, it holds the pin 154 firmly so that the weight 156 does not shift. As before, the position of the weight 156 along the pin 154 can be adjusted.

It should be clear that the weights 142 and 156, as well as the weight 38 in the first embodiment, may be replaced with larger or smaller weights by the golfer so that he can adjust the total mass of the head to effect the desired strength of impact on the ball. He can thus, using his same stroke, compensate for greens that are fast or slow; using a heavier weighted club when the greens are slow, as discussed above.

Above there is a description of the placement of the weight 38 in its bore 28 in a rightward or leftward position so as to compensate for the golfer's tendency to open or close the face. The same description applies to the placement of the weight 142 in the main part 118 of the modified head. This includes the shifting of the "sweet spot," etc.

The position of the weight 156 may be similarly adjusted, a more rearward position tending to retard the closing of the face, the weight being farther from the shaft 114 when in that rearward position.

On the other hand, the weight may be pushed forward to offer less compensation for a tendency to close the face, because the weight will be closer to the shaft 114 in that position.

The FIGS. 6–11 modification includes the exceptionally long sight line 128 and related sight lines 130 for golfers who prefer to hit high or low. These lines 128, 130 are a great assistance in lining up the ball for the putt.

Figure 6:
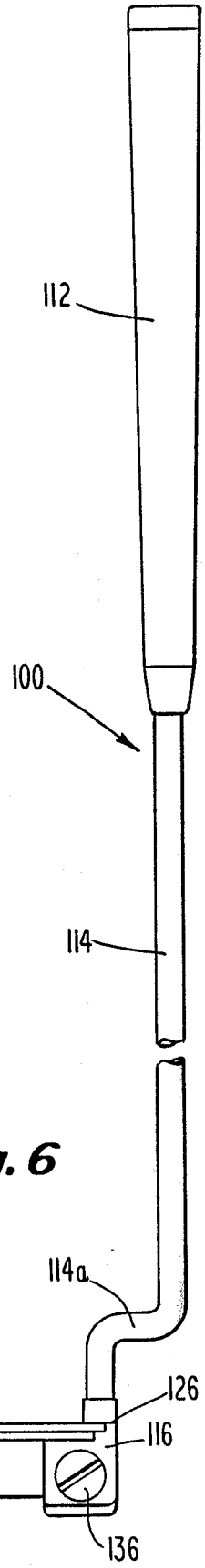
FIG. 6 is a side view of a putter embodying a modified form of the invention.

From FIG. 6 it should be noted the undersurface of the tail is above the level of the undersurface of the main portion 118. The result is that the tail portion does not contact the green or drag across it to spoil the putt.

Figure 10:
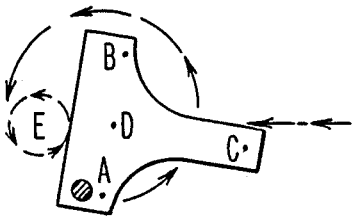
FIGS. 10 and 11 are diagrams showing the operation of the modified form.
Figure 11:
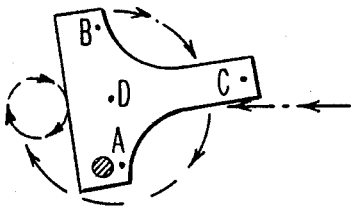

The phenomenon diagramed in FIGS. 10 and 11 has to do with the ability of the club head embodying the modified form of the invention, particularly, to instantly compensate for the unwanted creation of a spin on the ball due to the club face being canted at the time of impact.

With the weight of the club head at positions A, B and C at the three extremities of the T-shape club head, there is a tendency, upon the impact of the open face (FIGS. 10) with the ball E, to cause the club head to rotate about its center point D in a counterclockwise direction, imparting a similar counterclockwise rotation to the ball E. This is because the two ends A and C rotate the club face counterclockwise as shown, causing point B to snap to a more square position at impact. This gives the ball a slight momentary side spin as indicated to put it back on line, that is, the target line shown by the straight arrows to the right of the head.

Oppositely, there is a tendency, upon the impact of the closed face (FIG. 11) with the ball E, to cause the club head to rotate about its center point D in a clockwise direction, imparting a similar clockwise rotation to the ball E. This is again because the two weights A and C rotate the club face clockwise as shown, causing point B to snap to a more square position at impact. This gives the ball a slight momentary side spin as indicated to put it back on line, that is, the target line shown by the straight arrows to the right of the head.

It should be understood that the slight momentary side spin described is very minute. Yet it is important to take place at impact to cause the ball to veer back on to its target track.

As disclosed the invention relates to a putter having a head which can compensate for the conditions of the greens and for the individual golfer's swing. The stucture is relatively simple and further variations are possible. Thus, while the invention has been disclosed in a limited number of embodiments, the invention is not so limited but is susceptible to many changes and variations, all within the scope of the invention. The invention is defined by the following claim language and equivalents thereof.

What is claimed:

1. A golf putter comprising a T-shaped head having a flat putting face, the head having a first elongated recess therein parallel to, behind and substantially coextensive with the putting face, the first elongated recess having end walls at both ends including one removable end wall, comprising a plug threaded into the head, weight means in the recess comprising an elongated removable pin with its ends contacting the end walls respectively, a tubular weight disposed on the pin and of lesser length than the pin and adapted to be adustably fixed in a selected position along the pin, a first set screw threaded into a transverse hole in the weight and engaging the pin for fixing the weight at such selected position on the pin, an elongated tail extending perpendicularly rearward from a generally central location with respect to the length of the putter face, the tail having visual sight lines on its top and having therein a second elongated recess commencing to the rear of the first elongated recess and disposed on the longitudinal axis of the tail and having a closed front end wall and a removable end wall at the rear end of the tail comprising a second plug threaded into the hed, second weight means in the second elongated recess comprising a second removable pin with its ends contacting respectively the end walls of the second elongated recess, a second tubular weight disposed on the second pin and of lesser length than the second pin and adapted to be adjustably fixed in a selected position along the second pin, and a second set screw threaded into a transverse hole in the weight and engaging the second pin for fixing the second weight at such selected position, the first and second elongated recesses being substantially co-planar whereby the plugs can be removed and the weights and pins can be removed from their respective recesses and the weight balance of the putter can be adjusted by adjusting and fixing the position of the weight on the respective pins.

* * * * *